US005399454A

United States Patent [19]

Imai et al.

[11] Patent Number: 5,399,454

[45] Date of Patent: Mar. 21, 1995

[54] PIGMENT DISPERSION, ELECTROSTATIC IMAGE DEVELOPING TONER AND PROCESS FOR THE FORMATION OF MICROCAPSULE UTILIZING ISOCYANATE-CONTAINING ORGANOSILICON COATED PIGMENT

[75] Inventors: Takashi Imai; Takeshi Mikami, both of Minami-ashigara, Japan

[73] Assignee: Fuji Xerox Co., Ltd., Tokyo, Japan

[21] Appl. No.: 45,243

[22] Filed: Apr. 13, 1993

[30] Foreign Application Priority Data

Apr. 22, 1992 [JP] Japan ..... 4-128006

[51] Int. Cl.[6] ..... G03G 9/087

[52] U.S. Cl. ..... 430/109; 430/110; 430/137; 430/138

[58] Field of Search ..... 430/109, 137, 138, 110

[56] References Cited

U.S. PATENT DOCUMENTS

| | | | |
|---|---|---|---|
| 5,192,637 | 3/1993 | Saito et al. | 430/109 |
| 5,213,934 | 5/1993 | Sacripante et al. | 430/109 |

FOREIGN PATENT DOCUMENTS

| | | |
|---|---|---|
| 13-19574 | 9/1938 | Japan . |
| 17-446 | 1/1942 | Japan . |
| 50-22507 | 7/1975 | Japan . |
| 53-17737 | 2/1978 | Japan . |
| 58-7648 | 1/1983 | Japan . |
| 58-66948 | 4/1983 | Japan . |
| 59-148066 | 8/1984 | Japan . |
| 59-162562 | 9/1984 | Japan . |
| 2-31381 | 7/1990 | Japan . |

*Primary Examiner*—Mark A. Chapman
*Attorney, Agent, or Firm*—Oliff & Berridge

[57] ABSTRACT

A pigment dispersion is disclosed, comprising a pigment, an organic solvent, and at least one isocyanate-containing organosilicon compound selected from silylisocyanate derivatives represented by formulae (I), (II) and (III) and condensates thereof:

$$R_pR'_qR''_rSi(NCO)_{4-p-q-r} \quad (I)$$

$$(RO)_p(R'O)_q(R''O)_rSi(NCO)_{4-p-q-r} \quad (II)$$

$$R_x(R'O)_ySi(NCO)_z \quad (III)$$

wherein R, R′ and R″ each represents an alkyl group, an aryl group or an alkenyl group; p, q and r, which each represents 0 or an integer of from 1 to 3, satisfy the relationship ($p+q+r<3$); and x, y and z, which each represents an integer 1 or 2, satisfy the equation ($x+y+z=4$). An electrostatic image developing toner is also disclosed, comprising a pigment incorporated in a binder resin, wherein the pigment is one treated with at least one isocyanate-containing organosilicon compound selected from silylisocyanate derivatives represented by formulae (I), (II) and (III) and condensates thereof. Further, a process for forming a microcapsule is disclosed which comprises allowing at least a first capsule shell-forming monomer and a second capsule shell-forming monomer to undergo reaction inside and/or on the interface of oil drops to form capsule shells, the oil drops containing a pigment, an organic solvent, and at least one isocyanate-containing organosilicon compound selected from silylisocyanate derivatives represented by formulae (I), (II) and (III) and condensates thereof.

14 Claims, No Drawings

PIGMENT DISPERSION, ELECTROSTATIC IMAGE DEVELOPING TONER AND PROCESS FOR THE FORMATION OF MICROCAPSULE UTILIZING ISOCYANATE-CONTAINING ORGANOSILICON COATED PIGMENT

FIELD OF THE INVENTION

The present invention relates to a pigment dispersion, an electrostatic image developing toner, and a process for the formation of a microcapsule.

BACKGROUND OF THE INVENTION

The dispersion of a pigment has been a big technical subject in the field of electrophotography, liquid development, coating, ink, cosmetics, etc. It has been a general practice to treat the surface of pigment grains or inhibit secondary agglomeration under the control of the pigment manufacturing process for the purpose of improving the dispersibility of pigment in a solvent or resin. Also for coloring grains for use in a solid or liquid developer for the development of electrostatic images in electrophotography or the like, it has been known to treat the surface of these pigment grains with various materials for the purpose of improving the dispersibility of pigment. For example, JP-A-53-17737, and JP-A-58-7648 (The term "JP-A" as used herein means an "unexamined published Japanese patent application") disclose a process which comprises treating a pigment with a silane coupling agent or titanate coupling agent in a solvent, and then heating and drying the material to allow the silane coupling agent or titanate coupling agent to be chemically bonded to the surface of pigment.

However, the known pigment surface treatment process is disadvantageous in that since a pigment which has been treated in a solvent must be withdrawn from the solvent before the subsequent treatment, secondary agglomeration of pigment grains is enhanced, possibly producing sites of maldispersion. In recent years, there is a growing tendency toward color visual system. In electrophotographic toners, too, grain transparency and colorability have been demanded more and more. It has thus been desired to provide a pigment dispersion which exhibits an improved dispersibility as compared with the prior art.

On the other hand, as a method for obtaining colored grains for use in electrophotographic toners or the like other than the conventional grinding process, there has been well known a so-called wet process, i.e., process which comprises stirring a solution consisting of an oil phase and an aqueous phase to prepare colored fine grains. In the wet process, a pigment is normally incorporated in the oil phase to prepare colored fine grains. However, this wet process is disadvantageous in that since the pigment is poorly dispersed in the oil phase or the pigment exhibits a poor affinity for an organic solvent or binder resin, colored fine grains with a poor pigment dispersibility may be formed or the pigment may be desorbed from the grains.

SUMMARY OF THE INVENTION

It is therefore an object of the present invention to provide a pigment dispersion having a good pigment dispersibility.

It is another object of the present invention to provide an electrostatic image developing toner having a good pigment dispersibility.

It is further object of the present invention to provide a process for the preparation of a microcapsule which can be used for electrophotographic toners.

These and other objects of the present invention will become more apparent from the following detailed description and examples.

As a result of extensive study, the inventors found that the use of a certain kind of a silane compound in the dispersion of a pigment in an organic solvent enables the accomplishment of the aforementioned objects of the present invention. Thus, the present invention was worked out.

The present invention provides a pigment dispersion, comprising a pigment, an organic solvent, and at least one isocyanate-containing organosilicon compound selected from silylisocyanate derivatives represented by formulae (I), (II) and (III) and condensates thereof:

$$R_pR'_qR''_rSi(NCO)_{4-p-q-r} \quad (I)$$

$$(RO)_p(R'O)_q(R''O)_rSi(NCO)_{4-p-q-r} \quad (II)$$

$$R_x(R'O)_ySi(NCO)_z \quad (III)$$

wherein R, R′ and R″ each represents an alkyl group, an aryl group or an alkenyl group; p, q and r, which each represents 0 or an integer of from 1 to 3, satisfy the relationship ($p+q+r<3$); and x, y and z, which each represents an integer 1 or 2, satisfy the equation ($x+y+z=4$).

The electrostatic image developing toner of the present invention is formed by a pigment incorporated in a binder resin, wherein the pigment is one treated with the aforementioned isocyanate-containing organosilicon compound.

Further, the process for the formation of a microcapsule of the present invention comprises allowing at least a first capsule shell-forming monomer and a second capsule shell-forming monomer to undergo reaction inside and/or on the interface of oil drops to form capsule shells, characterized in that said reaction is allowed to occur with oil drops formed by the use of the aforementioned pigment dispersion.

DETAILED DESCRIPTION OF THE INVENTION

The present invention will be further described with reference to the pigment dispersion of the present invention.

The pigment dispersion of the present invention comprises a pigment, an organic solvent, and at least one isocyanate-containing organosilicon compound selected from silylisocyanate derivatives represented by formulae (I), (II) and (III) and condensates thereof. Further, the pigment dispersion of the present invention optionally comprises an active hydrogen compound or the like which brings about a good pigment dispersibility.

Specific examples of the isocyanate-containing organosilicon compound to be used in the present invention include the following silylisocyanate derivatives and hydrolyzates thereof: $(CH_3)_3SiNCO$, $(C_2H_5)_3SiNCO$, $(C_3H_7)_3SiNCO$, $(C_4H_9)_3SiNCO$, $(CH_3)(C_2H_5)(C_3H_7)SiNCO$, $(CH_3)(C_2H_5)_2SiNCO$, $(CH_3)_2(C_2H_5)SINCO$, $(CH_3)_3SiNCO$, $(CH_3)_2Si(NCO)_2$, $(C_2H_5)_2Si(NCO)_2$, $(C_3H_7)_2Si(NCO)_2$, $(C_4H_9)_2Si(NCO)_2$, $CH_3Si(NCO)_3$, $C_2H_5Si(NCO)_3$, $C_3H_7Si(NCO)_3$, $C_4H_9Si(NCO)_3$, $CH_2=CHSi(NCO)_3$, $CH_2=C(CH_3)Si(NCO)_3$, $(CH_3O)_3SiNCO$, $(C_2H_5O)_3SiNCO$, $(C_3H_7O)_3SiNCO$, $(C_4H_9O)_3SiNCO$, $(CH_{30})_2Si(NCO)_2$, $(C_2H_5O)_2Si(NCO)_2$, $(C_3H_7O)_2Si(NCO)_2$, $(C_4H_9O)_2Si(NCO)_2$, $CH_3OSi(NCO)_3$, $C_2H_5OSi(NCO)_3$, $C_3H_7OSi(NCO)_3$, $C_4H_9OSi(NCO)_3$, $Si(NCO)_4$, $(CH_3)(CH_3O)_2SiNCO$, $(C_2H_5)(C_2H_5O)_2SiNCO$, $(C_3H_7)(C_2H_5O)_2SiNCO$, $(C_4H_9)(C_3H_7O)_2Si(NCO)_2$, $(CH_3)(CH_3O)_2Si(NCO)$, $(C_2H_5)(C_2H_5O)_2Si(NCO)_2$, $(C_3H_7)(C_2H_5O)Si(NCO)_2$, $(C_4H_9)(C_2H_5O)Si(NCO)_2$, $(C_6H_5O)Si(NCO)_3$, $(C_6H_5O)_2Si(NCO)_2$ These silylisocyanate derivatives and hydrolyzates thereof may be used singly or in admixture.

On the other hand, as the pigment there may be used one having an active hydrogen site on the surface of grain. Specific examples of such a pigment include carbon black, nigrosine, aniline blue, chalcoyl blue, chrome yellow, ultramarine blue, Du Pont oil red, quinoline yellow, methylene blue chloride, phthalocyanine blue, malachite green oxalate, lamp black, Rose Bengal, C. I. pigment red 48:1, C. I. pigment red 122, C. I. pigment red 57:1, C. I. pigment yellow 97, C. I. pigment yellow 12, C. I. pigment blue 15:1, and C. I. pigment blue 15:3. Further, a magnetic powder can be used.

As an organic solvent there may be preferably used one which doesn't react with the aforementioned isocyanate-containing organosilicon compound. For example, an ester such as methyl acetate, ethyl acetate, butyl acetate and isopropyl acetate, an aliphatic saturated hydrocarbon or an organic solvent mainly comprising an aliphatic saturated hydrocarbon, a hydrocarbon solvent such as Isopar-G, Isopar-H and Isopar-L available from Exxon Chemical can be preferably used.

In the present invention, the pigment dispersion may comprise an active hydrogen-containing compound incorporated therein as necessary. Such an active hydrogen-containing compound is a compound containing an active hydrogen such as hydroxyl group, amino group, epoxy group and aldehyde or ketone having CH bond in s-position. For example, a pigment dispersant, synthetic resin or the like can be used as such a compound. Specific examples of such a pigment dispersant include bentonite, organic bentonire dispersant, metallic soap, hydrogenated castor oil wax, dibenzylidene sorbitol dispersant, oxidized polyethylene dispersant, and other surface active agents. As the synthetic resin there can be used any synthetic resin containing an active hydrogen.

The pigment dispersion of the present invention can be easily prepared by adding an organic solvent to a pigment, stirring the admixture by means of a sand mill for dispersion, adding the aforementioned isocyanate-containing organosilicon compound and optionally the aforementioned active hydrogen-containing compound to the material, and then stirring the admixture at ordinary temperature or an elevated temperature. The proportion of the amount of isocyanate-containing organosilicon compound to that of pigment can be properly selected but may be normally in the range of 0.01 to 10 parts, preferably 0.05 to 5 parts, to 1 part by weight of pigment.

In the above-described preparation method of the pigment dispersion of the present invention, the first stirring time and temperature by means of a sand mill are preferably for 1 minute to 36 hours at 0° to 30° C. and the second stirring time and temperature are preferably for 1 minute to 36 hours at 0° to 30° C. The organic solvent is added to the pigment in an amount of preferably 1 to 1000 parts by weight, more preferably 10 to 500 parts by weight, per part by weight of pigment. Further, the active hydrogen-containing compound is added to the isocyanate-containing organosilicon compound in an amount of preferably 0.01 to 1 part by weight, more preferably 0.05 to 0.5 part by weight, per part by weight of the isocyanate-containing organosilicon compound.

In the pigment dispersion of the present invention thus prepared, an isocyanate-containing organosilicon compound reacts with the surface of the pigment on the active hydrogen sites to render the pigment surface-treated. Further, in the present invention, the pigment is surface-treated in an organic solvent. Therefore, a problem caused by the conventional process comprising the treatment of a pigment with a silane coupling agent or titanate coupling agent containing an alkoxy group or a halogen atom, i.e., secondary agglomeration of pigment grains can be eliminated. Accordingly, even pigment grains finely divided by mechanical power can be uniformly surface-treated, providing an improved pigment dispersibility in an organic solvent and hence inhibiting the agglomeration or precipitation of pigment.

In the present invention, if as the isocyanate-containing organosilicon compound there is used one containing one isocyanate group, the isocyanate-containing organosilicon compound reacts with the surface of the pigment on the active hydrogen site as mentioned above, enabling the control of the hydrophilicity, hydrophobicity, polarity, etc. of the surface of the pigment. Also, if as the isocyanate-containing organosilicon compound there is used one containing two or more isocyanate groups, the isocyanate-containing organosilicon compound reacts with the surface of the pigment on the active hydrogen site. However, if the organic solvent in the pigment dispersion further comprises an active hydrogen-containing organic compound such as synthetic resin dissolved therein, it can be presumed that the isocyanate group in the isocyanate-containing organosilicon compound also reacts with the synthetic resin on the active hydrogen site, causing the pigment and the synthetic resin to be bonded to each other via the isocyanate-containing organosilicon compound. Since the synthetic resin is dissolved in the organic solvent, i.e., dispersed in a molecular state in the organic solvent, the pigment bonded to the synthetic resin is in a state of being fairly dispersed in the organic solvent. Further, if as the active hydrogen-containing compound there is used a pigment dispersant, the pigment and the pigment dispersant are presumed to be in a state of being bonded to each other via the isocyanate-containing organosilicon compound, making it possible to obtain an excellent dispersion in a similar manner as above.

The pigment dispersion of the present invention can find application in various industrial fields. For example, the pigment dispersion of the present invention can be used for the preparation of coating, printing ink, cosmetics, electrostatic developing toner for electrophotography, etc. The pigment dispersion of the present invention can also be used for the preparation of microcapsule, e.g., microcapsule toner for electrostatic image development.

The use of the aforementioned pigment dispersion in the preparation of electrostatic image developing toners will be described hereinafter.

The preparation of colored toner grains having a pigment dispersed in a binder resin may be carried out by adding a binder resin to the aforementioned pigment dispersion to make solution, and then atomizing the solution by an appropriate atomizing technique such as submerged drying process and spray drying process. This provides an electrostatic image developing toner comprising a pigment surface-treated with the aforementioned isocyanate-containing organosilicon compound fairly dispersed in the binder resin.

As the binder resin which can be used in the preparation of the aforementioned electrostatic image developing toner there can be used any binder resin soluble in the organic solvent for pigment dispersion. Examples of such a binder resin include styrene polymers obtained by polymerization of styrene, methylstyrene, dimethylstyrene, trimethylstyrene, ethylstyrene or the like, acrylic ester polymers such as polyacrylic methyl, polyacrylic ethyl, polyacrylic butyl, 2-ethylhexyl acrylate and lauryl polyacrylate, methacrylic ester polymers such as methyl polymethacrylate, ethyl polymethacrylate, butyl polymethacrylate, 2-ethylhexyl polymethacrylate and lauryl polymethacrylate, copolymers of styrene monomer and acrylic ester or methacrylic ester, polyvinyl acetate, polyvinyl propionate, polyvinyl butyrate, polyethylene, polypropyrene, other ethylene polymers and copolymers, styrene-butadiene copolymers, styrene-isoprene copolymers, styrene-maleic acid copolymers, polyvinyl ethers, polyvinyl ketones, polyesters, polyamides, polyurethanes, and polyvinyl butyrals.

Among these binder resins, polyesters are preferably used taking into account the coloring properties after fixing, image strength, etc. In particular, linear polyesters obtained by the condensation polymerization of a polyol component with a polyvalent carboxylic acid or acid anhydride thereof or lower alkylester thereof are preferably used. Preferred examples of such polyol components include diols represented by formulae (IV) and (V):

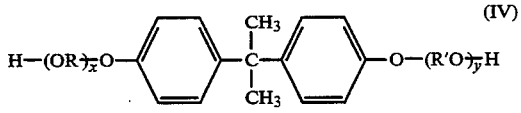

(IV)

$$HO-(CH_2)_m-OH \quad (V)$$

wherein R and R' each represents an ethylene or propylene group; x and y each represents an integer 1 or more; and m represents an integer of from 2 to 6.

In formula (IV), the upper limit of x and y is 15, and x and y each is preferably an integer of from 3 to 8, more preferably an integer of from 4 to 6.

As the diols represented by formula (IV) there may be preferably used polyoxypropylene(2,2)-2,2-bis(4-hydroxyphenyl)propane, and polyoxypropylene(3,3)-2,2-bis(4-hydroxyphenyl)propane.

As the diols represented by formula (V) there may be preferably used ethylene glycol, 1,3-propylene glycol, and 1,4-butanediol.

In the present invention, these diols may be used singly or in admixture.

Examples of the polyvalent carboxylic acid include divalent carboxylic acid such as phthalic acid, isophthalic acid, terephthalic acid, fumaric acid, maleic acid and succinic acid, and trivalent carboxylic acid such as 1,2,4-benzenetricarboxylic acid, 2,5,7-naphthalenetricarboxylic acid and 1,2,4-naphthalenetricarboxylic acid.

These polyvalent carboxylic acids can be used singly or in admixture.

The aforementioned polyester can be used in combination with other resins. Examples of resins with which the polyester can be used include polystyrene, styrene-methacrylic alkyl copolymer, styrene-acrylic alkyl copolymer, styrene-acrylonitrile copolymer, styrene-butadiene copolymer, styrene-maleic anhydride copolymer, polyethylene, and polypropylene.

The preparation of a so-called microcapsule toner comprising a core made of a liquid or solid substance having a pigment dispersed therein surrounded by a capsule shell can be accomplished by a known microcapsulization technique such as interfacial polymerization, coacervation process, phase separation process and in-situ polymerization process. In the present invention, a microcapsule formation process which comprises allowing a first capsule shell-forming monomer and a second capsule shell-forming monomer to undergo reaction inside and/or on the interface of oil drops to form a capsule shell may be preferably used.

An example of the microcapsule formation process is an in-situ polymerization process described in JP-B-50-22507 (The term "JP-B" as used herein means an "examined Japanese patent publication") which comprises allowing a first capsule shell-forming monomer and a second capsule shell-forming monomer to undergo reaction inside and on the interface of oil drops to form a capsule shell. In this process, a first capsule shell-forming monomer and a second capsule shell-forming monomer are incorporated in the aforementioned pigment dispersion. The pigment dispersion is contained in an aqueous medium as oil drops inside which these monomers are allowed to undergo polymerization to form a capsule shell.

Another example of the capsule formation process is an interfacial polymerization process described in JP-B-38-19574, JP-B-42-446, JP-A-58-66948, JP-A-59-148066. JP-A-59-162562, and JP-B-2-31381 which comprises allowing a first capsule shell-forming monomer present inside oil drops and a second capsule shell-forming monomer present outside oil drops to undergo reaction on the interface of oil drops to form a capsule shell. In this process, a first capsule shell-forming monomer is incorporated in an aqueous medium while a second capsule shell-forming monomer is incorporated in the aforementioned pigment dispersion to form oil drops. These monomers are allowed to undergo polymerization on the interface of oil drops to form a capsule shell.

Further, the two processes may be combined to effect reaction inside and on the surface of oil drops.

Specific examples of the first capsule shell-forming monomer to be used in the aforementioned microcapsule formation process include water, polyol such as ethylene glycol, 1,4-butanediol, catechol, resorcinol, hydroquinone, o-dihydroxymethylbenzene, 4,4'-dihydroxydiphenylmethane, bisphenol A and 2,2'-bis(4-hydroxyphenyl)-propane, polyamine such as ethylenediamine, tetramethylenediamine, hexamethylenediamine, phenylenediamine, diethylenetriamine, triethylenetetramine, diethylaminopropylamine and tetraethylenepentamine, and piperazine compound such as piperazine, 2-methylpiperazine and 2,5-dimethylpiperazine.

Examples of the second capsule shell-forming monomer include polyisocyanate, epoxy compound, and dibasic halide. Preferred among these materials is polyisocyanate. Specific examples of such a polyisocyanate include diisocyanates such as methaphenylene diisocyanate, tolylene diisocyanate, diphenylmethane diisocyanate, 3,3'-dimethyl-diphenyl-4,4' -diisocyanate,3,3'-dimethyl-diphenylmethane-4,4'-diisocyanate, xylylene diisocyanate, naphthalene diisocyanate and hexamethylene diisocyanate, and polyisocyanates known as burette type, adduct type and isocyanurate type polyisocyanurates, such as adduct of 3 mols of xylylenediisocyanates and 1 mol of trimethylolpropane.

Examples of the epoxy compound include epoxy compounds known as bisphenol A type, resorcin, bisphenol F type, tetrahydroxyphenylmethane type, novolak type, polyalcohol type, polyglycol type and glycerin triether type epoxy compounds.

Examples of the dibasic halide include adipoyl dichloride, phthaloyl dichloride, terephthaloyl dichloride, and 1,4-cyclohexanedicarbonyl chloride. These dibasic halides may be used in admixture.

The molar ratio of the first capsule shell-forming monomer to the second capsule shell-forming monomer is from 1:10 to 10:1, preferably from 1:5 to 5:1.

In the case where the microcapsule is used as an electrostatic image developing capsule toner, a binder resin may be contained in the oil drops when the microcapsule is prepared by the aforementioned microcapsulization process. A soft solid or oleaginous oil may be contained in the oil drops as necessary. As such a binder resin there may be used those exemplified above.

As the oleaginous oil there may be preferably used an oily solvent having a boiling point of 140° C. or higher, more preferably 160° C. or higher, which can dissolve a binder resin therein. Such an oleaginous oil can be selected from those described in, e.g., the section of "Plasticizers" in *Modern Plastics Encyclopedia* (1975–1976). Specific examples thereof include phthalic esters (e.g., diethyl phthalate, dibutyl phthalate), aliphatic dicarboxylic esters (e.g., diethyl malonate, dimethyl oxalate), phosphoric esters (e.g., tricresyl phosphate, trixylyl phosphate), citric esters (e.g., o-acetyltriethyl citrate), benzoic esters (e.g., butyl benzoate, hexyl benzoate), aliphatic esters (e.g., hexadecyl myristate, dioctyl adipate), alkylnaphthalenes (e.g., methyl naphthalene, dimethyl naphthalene, monoisopropyl naphthalene, diisopropyl naphthalene), alkyldiphenylethers (e.g., o-, m-, p-methyldiphenylether), higher aliphatic or aromatic sulfonic amide compounds (e.g., N,N-dimethyllauroamide, N-butylbenzenesulfonamide), trimellitic esters (e.g., trioctyl trimellitate), diarylalkanes (e.g., diarylmethane such as dimethylphenylphenylmethane, and diarylethane such as 1-phenyl-1-methylphenylethane, 1-dimethylphenyl-1-phenylethane and 1-ethylphenyl-1-phenylethane), and chlorinated paraffins.

The resin shell of the present invention is in the form of a microcapsule which exhibits sufficient isolatability with respect to the core substance at the storing temperature of the toner composition. For example, the resin shell isolates the core substance to inhibit the heat agglomeration of the toner composition when the toner composition is stored at a temperature of 60° C. for a prolonged period of time but momentarily exhibits sufficient permeability to the molten core substance so that it is eluted therefrom to provide a heat fixability at a desired heat fixing temperature higher than a certain temperature.

In order to provide the resin shell with the aforementioned functions, the constituent materials of the resin shell, the glass transition point (Tg) of the resin shell, and the thickness of the resin shell should be properly selected. In the present invention, as the shell-forming resin there can be used polyurea and/or polyurethane. These polyurea and/or polyurethane need to exhibit a glass transition point of 150° C. or lower, preferably 80° C. to 140° C. in the light of response to process speed and anti-blocking properties. When the glass transition point is 150° C. or higher, the fixing temperature is too high to accomplish the effects of the present invention. The glass transition point is measured by differential scanning calorimetry (DSC). In this method, a resin film prepared on a glass plate is heated at a rate of 5° C./min. by a differential thermal analyzer (Type DT-40 Thermal Analyzer available from Shimadzu Corporation). The glass transition point is determined from the shoulder section on the endothermic curve.

The glass transition point of the resin constituting the shell can be estimated from the flexibility of branch chain in the resin, the distance between crosslinking points, etc. The relationship between the resins constituting the shell which can be used in the present invention and their glass transition points will be given below.

TABLE 1

| Model No. | Material constituting resin shell | Tg (°C.) |
|---|---|---|
| 1 | $C_2CH_5O-(CH_2OCONH-(CH_2)_6-NCO)_3/H_2O$ | 95 |
| 2 | 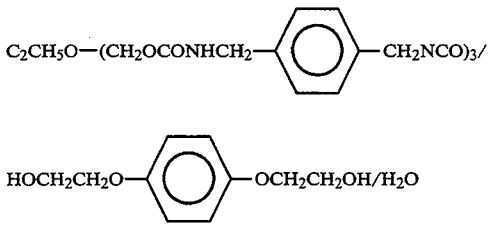 | 105 |
| 3 | 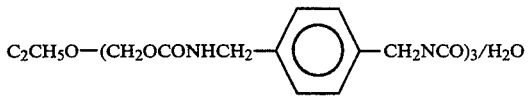 | 130 |

TABLE 1-continued

| Model No. | Material constituting resin shell | Tg (°C.) |
|---|---|---|
| 4 | 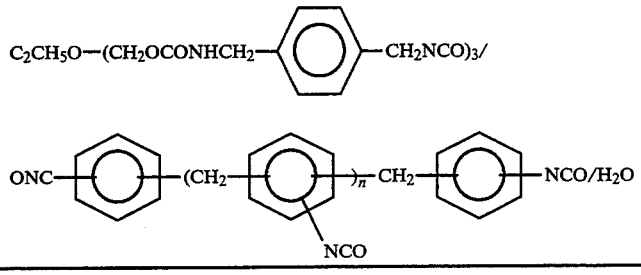 | 150 |

In the present invention, the thickness of the resin shell needs to be in the range of 0.005 μm to 0.5 μm. If the thickness of the resin shell exceeds 0.5 μm, the heat response is poor, reducing the permeation of the core substance and hence making it impossible to obtain sufficient fixing strength. If the thickness of the resin shell falls below 0.005 μm, the strength of the resin shell is disadvantageously reduced, making it impossible to accomplish the functions of the shell.

When the microcapsule formed according to the present process is used as an electrophotographic toner for electrostatic image development, a monomer for the provision of chargeability may be used. For example, a monomer such as an amino-containing methacrylate and quaternary ammonium salt-containing methacrylate, if a positive chargeability is provided, or a monomer such as methacrylic acid and trifluoroethyl methacrylate, if a negative chargeability is provided, may be contained with the microcapsule in water or an organic solvent, optionally a mixture thereof, and then heated. In this manner, a desired chargeability can easily be given to the microcapsule.

The aforementioned electrostatic image developing toner of the present invention may further comprise additives such as silicon oxide, aluminum oxide and titanium oxide incorporated therein to obtain fluidity or chargeability.

The present invention will be further described in the following examples, but the present invention should not be construed as being limited thereto. The term "part" as used herein indicates "part by weight".

EXAMPLE 1

(a) Preparation of pigment dispersion

| | |
|---|---|
| Phthalocyanine blue (C. I. Pigment Blue 15:3) | 2 parts |
| Polyester resin (acid value: 2.7; hydroxyl number: 34.8; Tg: 50° C.) | 2 parts |
| Ethyl acetate | 200 parts |
| Pigment dispersant | |
| Solsperse 5000 (available from Imperial Chemical Industries) | 0.1 part |
| Solsperse 24000 (available from Imperial Chemical Industries) | 0.4 part |

The mixture of these components was stirred by means of a sand mill for 1 hour to obtain a pigment dispersion. To the pigment dispersion were added 3 parts of methylsilyl triisocyanate (Orgatics SI310 available from Matsumoto Seiyaku Kogyo K.K.). The material was then stirred at room temperature for 1 hour to obtain a pigment dispersion of the present invention. The pigment dispersion thus obtained was then allowed to stand. After about 1 month, there were observed no pigment agglomeration and precipitation.

(b) Preparation of capsule toner 20 g of the aforementioned pigment dispersion was measured out. To the material was then added 10 g of the same polyester resin as mentioned above to make solution. 2 g of an adduct of 3 mols of xylylene diisocyanate and 1 mol of trimethylol propane (Takenate D-110N available from Takeda Chemical Industries, Ltd.) was then dissolved in the material to obtain a mixed solution of oil phase.

The mixed solution of oil phase was then added to and emulsion-dispersed in 80 parts of a 0.1 wt. % aqueous solution of polyvinyl alcohol to obtain an oil-in-water type emulsion comprising oil drops having an average grain size of 3 μm. This oil-in-water type emulsion was stirred in a 50° C. constant temperature bath for 3 hours to finish the interfacial polymerization reaction of isocyanate with water.

The resulting microcapsule dispersion was then subjected to centrifugal separation to cause the microcapsules to be sedimented. The upper aqueous phase was removed from the system. A washing water was then added to the system. The material was then stirred for redispersion. This washing procedure was repeated 6 times to remove deposits such as polyvinyl alcohol from the surface of the microcapsules. To the microcapsules thus obtained were added 100 parts of distilled water. The material was then dried by means of a freeze dryer to remove water content therefrom. Thus, colored grains were obtained.

A section of these colored grains was then observed to have pigment grains fairly dispersed therein.

To these colored grains was then added 3% by weight of a hydrophobic silica to obtain an electrophotographic toner. This toner was then mixed with a carrier. The toner was supplied into an electrophotographic copying machine (remodelled version of 5030 available from Fuji Xerox Co., Ltd.) for copy test. As a result, an image with an excellent image quality was obtained.

EXAMPLE 2

(a) Preparation of pigment dispersion

| | |
|---|---|
| Magenta pigment having the following structural formula | 2 parts |

-continued

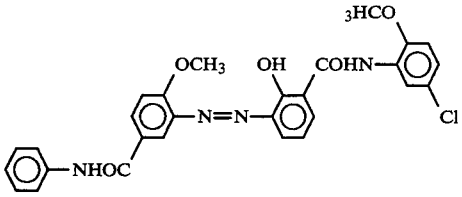

| Ethyl acetate | 200 parts |
|---|---|

The mixture of these components was subjected to milling by means of a sand mill in the same manner as in Example 1. To the material was then added 1 part of trimethylsilyl isocyanate (Orgatics SI130 available from Matsumoto Seiyaku Kogyo K.K.). The material was then stirred at room temperature for 1 hour to obtain a pigment dispersion of the present invention.

(b) Preparation of capsule toner

Colored grains were obtained from the aforementioned pigment dispersion in the same manner as in Example 1. When no trimethylsilyl isocyanate was added to the system, the pigment migrated to the aqueous phase during emulsification. On the contrary, when emulsification was effected with a pigment dispersion of the present invention, the pigment didn't migrate to the aqueous phase, providing colored grains having pigment grains fairly dispersed therein.

To these colored grains was then added 3% by weight of a hydrophobic silica to obtain an electrophotographic toner. This toner was then mixed with a carrier. The toner was supplied into an electrophotographic copying machine (remodelled version of 5030 available from Fuji Xerox Co., Ltd.) for copy test. As a result, an image with an excellent image quality was obtained.

Since the pigment dispersion of the present invention comprises the aforementioned isocyanate-containing organosilicon compound, it exhibits a high reactivity to the surface of the pigment and hence provides remarkably improved pigment dispersibility in an organic solvent as compared with the conventional silane coupling agent or titanate coupling agent containing an alkoxy group or halogen atom utilizing hydrolyzation reaction.

Further, in the electrostatic image developing toner prepared from the pigment dispersion of the present invention, the surface of the pigment is treated with the aforementioned isocyanate-containing organosilicon compound. Accordingly, the pigment is fairly dispersed in the binder resin. Thus, an image with an excellent image quality can be obtained.

While the invention has been described in detail and with reference to specific embodiments thereof, it will be apparent to one skilled in the art that various changes and modifications can be made therein without departing from the spirit and scope thereof.

What is claimed is:

1. A pigment dispersion comprising (a) a pigment, (b) an organic solvent, and (c) at least one isocyanate-containing organosilicon compound selected from silylisocyanate derivatives represented by formulae (I), (II) and (III) and condensates thereof:

$$R_pR'_qR''_rSi(NCO)_{4-p-q-r} \quad (I)$$

$$(RO)_p(R'O)_q(R''O)_rSi(NCO)_{4-p-q-r} \quad (II)$$

$$R_x(R'O)_ySi(NCO)_z \quad (III)$$

wherein R, R' and R'' each represents an alkyl group, an aryl group or an alkenyl group; p, q and r, which each represents 0 or an integer of from 1 to 3, satisfy the relationship ($p+q+r<3$); and x, y and z, which each represents an integer 1 or 2, satisfy the equation ($x+y+z=4$).

2. An electrostatic image developing toner, comprising a pigment incorporated in a binder resin, wherein said pigment is one treated with at least one isocyanate-containing organosilicon compound selected from silylisocyanate derivatives represented by formulae (I), (II) and (III) and condensates thereof:

$$R_pR'_qR''_rSi(NCO)_{4-p-q-r} \quad (I)$$

$$(RO)_p(R'O)_q(R''O)_rSi(NCO)_{4-p-q-r} \quad (II)$$

$$R_x(R'O)_ySi(NCO)_z \quad (III)$$

wherein R, R' and R'' each represents an alkyl group, an aryl group or an alkenyl group; p, q and r, which each represents 0 or an integer of from 1 to 3, satisfy the relationship ($p+q+r<3$); and x, y and z, which each represents an integer 1 or 2, satisfy the equation ($x+y+z=4$).

3. An electrostatic image developing toner according to claim 2, wherein said binder resin is selected from the group consisting of styrene polymer, acrylic ester polymer, methacrylic ester polymer, copolymer of styrene monomer and acrylic ester, copolymer of styrene monomer and methacrylic ester, polyvinyl acetate, polyvinyl propionate, polyvinyl butyrate, ethylene polymer, ethylene copolymer, polypropylene, styrene-butadiene copolymer, styrene-isoprene copolymer, styrene-maleic acid copolymer, polyvinyl ether, polyvinyl ketone, polyester, polyamide, polyurethane and polyvinyl butyral.

4. An electrostatic image developing toner according to claim 2, wherein said binder resin comprises a linear polyester obtained by the condensation polymerization of a polyol component with a polyvalent carboxylic acid or acid anhydride thereof or lower alkyl ester thereof.

5. An electrostatic image developing toner according to claim 4, wherein said polyol component comprises a diol comprising

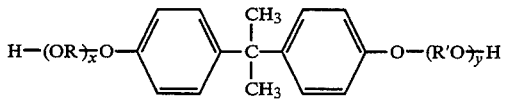

or $$HO-(CH_2)_m-OH$$

wherein R, and R' each represents an ethylene or propylene group; X and Y each represents an integer of one or more and X and Y is $<15$ and m represents an integer of from 2 to 6.

6. An electrostatic image developing toner according to claim 4, wherein said polyvalent carboxylic acid is phthalic acid, isophthalic acid, terephthalic acid, fumaric acid, maleic acid, succinic acid, 1,2,4-benzene tricarboxylic acid, 2,5,7naphthalenetricarboxylic acid or 1,2,4-naphthalenetricarboxylic acid.

7. An electrostatic image developing toner according to claim 4, wherein said polyester is used in combination with a polystyrene, styrene-methacrylic alkyl copolymer, styrene-acrylic alkyl copolymer, styrene-acrylonitrile copolymer, styrene-butadiene copolymer, styrene-maleic anhydride copolymer, polyethylene or polypropylene.

8. An electrostatic image developing toner according to claim 4, wherein said toner is in the form of a microcapsule toner comprising a core having a liquid dispersed therein surrounded by a capsule shell.

9. A process for forming a microcapsule which comprises allowing at least a first capsule shell-forming monomer and a second capsule shell-forming monomer to undergo reaction inside and/or on the interface of oil drops to form capsule shells, said oil drops containing a pigment, an organic solvent, and at least one isocyanate-containing organosilicon compound selected from silylisocyanate derivatives represented by formulae (I), (II) and (III) and condensates thereof:

$$R_pR'_qR''_rSi(NCO)_{4-p-q-r} \quad (I)$$

$$(RO)_p(R'O)_q(R''O)_rSi(NCO)_{4-p-q-r} \quad (II)$$

$$R_x(R'O)_ySi(NCO)_z \quad (III)$$

wherein R, R′ and R″ each represents an alkyl group, an aryl group or an alkenyl group; p, q and r, which each represents 0 or an integer of from 1 to 3, satisfy the relationship $(p+q+r<3)$; and x, y and z, which each represents an integer 1 or 2, satisfy the equation $(x+y+z=4)$.

10. A process for forming a microcapsule according to claim 9, comprising forming a pigment dispersion comprising a pigment, an organic solvent and said at least one isocyanate-containing organosilicon compound;

forming an oil phase comprising said pigment dispersion with a first shell-forming monomer;

reacting said first shell-forming monomer with a second shell-forming monomer to form a microcapsule comprising a core having dispersed pigment surrounded by capsule shell.

11. A process according to claim 10, wherein said microcapsule is formed by interfacial polymerization, a coacervation process, a phase separation process or an in-situ polymerization process.

12. A process according to claim 10, comprising allowing said first capsule shell-forming monomer and said second capsule shell-forming monomer to undergo reaction inside and on the interface of said oil drops to form a capsule shell.

13. A process according to claim 10, wherein said first capsule shell-forming monomer is present within said oil phase and said second capsule shell forming monomer is present outside said oil phase and said first capsule shell-forming monomer and said second capsule shell-forming monomer undergo reaction at the interface of said oil phase to form said capsule shell.

14. A process according to claim 10, wherein said first capsule shell-forming monomer is incorporated into an aqueous medium while said second capsule shell-forming monomer is incorporated into said pigment dispersion and said monomers undergo polymerization at the interface of said oil phase to form said capsule shell.

* * * * *